US005846901A

United States Patent [19]

Jubran

[11] Patent Number: 5,846,901

[45] Date of Patent: Dec. 8, 1998

[54] COLOR-FORMING COMPOUNDS AND THEIR USE IN CARBONLESS IMAGING

[75] Inventor: Nusrallah Jubran, St. Paul, Minn.

[73] Assignee: Minnesota Mining and Manufacturing Company, St. Paul, Minn.

[21] Appl. No.: 609,819

[22] Filed: Mar. 1, 1996

[51] Int. Cl.[6] ..... B41M 5/136

[52] U.S. Cl. ..... 503/201; 427/151; 503/215; 503/218; 503/226

[58] Field of Search ..... 548/400; 549/29, 549/505; 427/150, 151; 503/215, 217, 218, 226, 201

[56] References Cited

U.S. PATENT DOCUMENTS

| | | | |
|---|---|---|---|
| 4,041,193 | 8/1977 | Hayashi et al. | 427/151 |
| 4,808,566 | 2/1989 | Takashima et al. | 503/217 |
| 4,933,448 | 6/1990 | Fletcher | 544/140 |
| 5,189,188 | 2/1993 | Eckstein | 552/104 |

FOREIGN PATENT DOCUMENTS

WO 9317877 9/1993 WIPO .

OTHER PUBLICATIONS

Avendano et al., "CNMR Study of Polyaryl– and Poly–C–heteroaryl–carbinols and Their Carbonium Salts," *Magnetic Resonance in Chemistry,* vol. 28, pp. 1011–1017 (1990).

Diego et al., "Heteroaromatic Analogues of Triarylmethane Dyes," *Chemica Scripta,* vol. 28, pp. 403–409 (1988).

Diego et al., "Effect of heterocyclic analogues of triphenylmethane dyes against Trypanosoma cruzi," *Annals of Tropical Medicine and Parasitology,* vol. 82, No. 3, pp. 235–241 (1988).

Ishii et al., "Preparation of 2,5–Bis(diarylmethylene)–2,5–dihydrothiophenes and Their Furan, Selenophene, and N–Methylpyrrole Analogs," *Tetrahedron Letters*, vol. 32, No. 34, pp. 4313–4316 (1991).

Renshaw et al., "Dyes Containing the Furane Cycle," Contribution from the Havemeyer Chemical Laboratory of New York University and the Chemical Laboratory of Iowa State College, pp. 862–864 (1922).

Katritzky et al., "Directed Metalation of Benzenesulfinamides. A Novel Route to Meta–Substituted Aromatic Compounds," *J. Org. Chem.,* vol. 55, pp. 74–78 (1990).

Cigen et al., "Equilibrium and Kinetic Studies on Halide Derivatives of Malachite Green," *ACTA Chemica Scandinavica,* vol. 17, pp. 2083–2090 (1963).

*Primary Examiner*—Bruce H. Hess

[57] ABSTRACT

This invention includes novel 2,5-bis-[bis[(4-amino)phenyl]hydroxymethyl]substituted furan, thiophene, and pyrrole color-forming compounds and the reaction of these compounds or 2-mono-[bis[(4-amino)phenyl]hydroxymethyl]substituted furan, thiophene, and pyrrole color-forming compounds to form colored compounds. The invention also includes the use of these color-forming compounds in the manufacture and imaging of thermal imaging papers and pressure-sensitive imaging papers.

13 Claims, No Drawings

COLOR-FORMING COMPOUNDS AND THEIR USE IN CARBONLESS IMAGING

FIELD OF INVENTION

This invention relates to color-forming compounds; the reaction of these compounds to form colored compounds; and the use of these color-forming compounds in the manufacture and imaging of thermal imaging papers and pressure-sensitive imaging papers.

BACKGROUND TO THE ART

Color forming compounds are useful in a wide variety of products, including carbonless papers. Products using color-forming compounds frequently comprise at least two reactants, a color-forming compound and a developer, and a means for preventing premature reaction of the reactants.

Carbonless paper imaging finds application in such areas as credit card receipts and multipart forms. Carbonless paper imaging involves forming an image by the application of pressure to the carbonless paper. For carbonless paper products, one of the reactants is typically encapsulated to prevent premature reaction of the color-forming compound with the developer. Preferably, a fill solution of the color-forming compound or compounds in a hydrophobic solvent is encapsulated or contained in microcapsules. When activating pressure is applied to the carbonless paper, such as from a stylus or a typewriter key, the capsules rupture, the solution of encapsulated color-forming compound is released, and a reaction between the previously separated reactants occurs. In general, the resulting reaction will form a colored image corresponding to the path traveled by the stylus or the pattern of pressure provided by the stylus or key.

A common construction has a top sheet referred to as a donor sheet or coated back sheet (CB). Preferably, the material coated on the backside comprises a suitable binder and microcapsules containing color-forming compounds and solvent. This top sheet is used in conjunction with a second sheet, known as a receptor sheet, that is coated on the frontside (CF). The coating on the frontside of the second sheet comprises a developer, optionally in a suitable binder. The term "suitable binder" refers to a material, such as starch or latex, that allows for dispersion of the reactants in a coating on a substrate.

The two sheets are positioned such that the backside of the donor sheet faces the developer coating on the front side of the receptor sheet. In many applications the front surface of the donor (CB) and receptor (CF) sheets contain preprinted information of some type and the activating pressure is generated by means of a pen or other writing instrument used in filling out the form. Thus, the image appearing on the receptor sheet is a copy of the image applied to the front side of the donor sheet. Optionally, intermediate sheets having one surface coated with the encapsulated color-forming compound, and a second, opposite surface, coated with a developer, can be placed between the CF and CB sheets. Such sheets are generally referred to herein as "CFB" sheets (i.e., coated front and back sheets). Of course, each side including color-forming compound thereon should be placed in juxtaposition with a sheet having developer thereon.

Constructions comprising at least a first substrate surface, on which is coated the encapsulated color-forming compound, and a second substrate surface, on which is coated a developer, are often referred to as a "set" or a "form-set" construction. The sheets in form-sets are typically secured to one another, e.g. as with an adhesive. In a multi-page form-set the sheets are sequenced in the order from top to bottom CB, CFB(s), and CF. This insures that in each form-set a color-forming compound and a color developer will be brought into contact when the microcapsules containing the color-forming compound are ruptured by pressure.

An alternative to the use of CB, CF, and CFB sheets is the self-contained (SC), or autogenous, carbonless paper in which both the color-forming compound and developer are applied to the same side of the sheet and/or are incorporated into the fiber lattice of the paper sheet. See e.g., European Patent Application 627 994 A1. Self-contained carbonless paper sheets are frequently used as the second and additional sheets in form-sets.

Color-forming compounds useful in carbonless paper products preferably should be capable of being encapsulated. A wide variety of processes exist by which microcapsules can be manufactured and a wide variety of capsule materials can be used in making the capsule shells, including gelatin and synthetic polymeric materials. Three methods that have achieved commercial utility are referred to as in-situ polymerization, interfacial polymerization, and coacervation encapsulation. Popular materials for shell formation for in-situ polymerization include the product of the polymerization reaction between such materials as urea and formaldehyde (UF capsules), melamine and formaldehyde (MF capsules), and monomeric or low molecular weight polymers of dimethylolurea or methylolated urea and aldehydes. Popular materials for interfacial polymerization include reaction of a polyisocyanate with a polyamine. The preparation of capsules by in-situ and interfacial polymerization and of carbonless sheets employing these capsules is disclosed in European Patent Application 0 539 142 A1. Popular materials for shell formation using coacervation polymerization include gelatin, albumin, starch, agar, carboxymethylcellulose, gum arabic, and mixtures of these materials.

In addition, the color-forming compound should be soluble and non-reactive with the fill solvent used for the encapsulation, insoluble in the aqueous solution used as the dispersing phase, non-reactive with other color-forming compounds present in the encapsulation medium, and non-reactive with the materials used to form capsule walls. Finally, the color-forming compound preferably forms a stable colored image nearly instantaneously upon contact with a receptor sheet. The color reaction helps ensure creation of an accurate, almost instantly readable copy. The stability of the colored image is important because an image that fades over time is generally undesirable.

In addition to their use in carbonless paper, color-forming compounds are used in thermal imaging constructions. These elements rely on the use of heat to produce an image. Thermal imaging constructions generally comprise a support, such as paper, glass, plastic, metal, etc., coated with (a) an acid developable color-forming compound; (b) an acidic developer; and (c) binder. At elevated temperatures the developer reacts with the acid developable color-forming compound to form a colored image corresponding to the pattern in which heat was applied to the thermal imaging construction. The image may be applied by contacting the imaging construction with a thermal print head or by other heating means. Typically, the activating temperature is in the range from 60° to 225° C.

Commonly used classes of color-forming compounds for carbonless paper applications and thermal imaging include fluorans, rhodamines, and triarylmethane lactone color-forming compounds. All of these compounds react with acidic developers, such as Lewis acid, salicylic acid, phenolic compound, or acidic clay, to form highly colored species by the opening of a lactone ring. Specific, examples of such compounds are Pergascript Black I-R (a fluoran) and crystal violet lactone (a triarylmethane lactone).

SUMMARY OF THE INVENTION

One aspect of this invention is a class of novel 2,5-bis-[bis[(4-amino)phenyl]hydroxymethyl]substituted furan, thiophene and pyrrole color-forming compounds. Preferably, these compounds have the central nucleus:

1

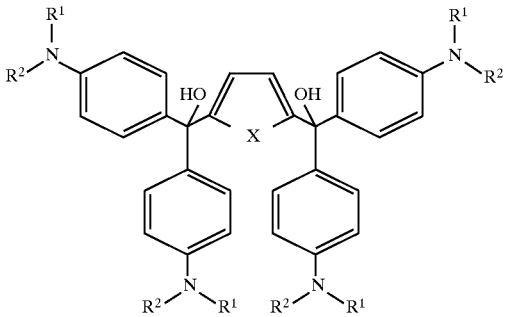

wherein;

each $R^1$ and $R^2$ is independently selected from alkyl groups of up to 20 carbon atoms, alkenyl groups of up to 20 carbon atoms, and aryl groups of up to 14 carbon atoms; or $R^1$ and $R^2$ of each $NR^1R^2$ group may represent the necessary atoms to complete a 5-, 6-, or 7-membered heterocyclic ring group; or one or more $R^1$ and $R^2$ of each $NR^1R^2$ group may represent the atoms necessary to complete a 5- or 6-membered heterocyclic ring group fused to the phenyl ring on which the $NR^1R^2$ group is attached;

X is O, S, or N—$R^3$, and $R^3$ is selected from alkyl groups of up to 20 carbon atoms, alkenyl groups of up to 20 carbon atoms, and aralkyl groups of up to 20 carbon atoms. Preferably, $R^1$ and $R^2$ are alkyl groups of up to 10 carbon atoms. Preferably, $R^3$ is an alkyl group of up to 10 carbon atoms.

Another aspect of this invention is a composition comprising a 2,5-bis-[bis[(4-amino)phenyl]hydroxymethyl] substituted furan, thiophene and pyrrole color-forming compound carried in a solvent.

Another aspect of this invention is a composition comprising a color-forming compound selected from the group consisting of 2-mono-[bis[(4-amino)phenyl] hydroxymethyl]substituted furan, thiophene and pyrrole compounds and 2,5-bis-[bis[(4-amino)phenyl] hydroxymethyl]substituted furan, thiophene and pyrrole color-forming compounds, and a solvent, wherein the solvent and the color-forming compound are encapsulated in a substantially impermeable, pressure-rupturable microcapsule. Preferably the2-mono-[bis[(4-amino)phenyl] hydroxymethyl]substituted furan, thiophene and pyrrole compounds have the central nucleus

2

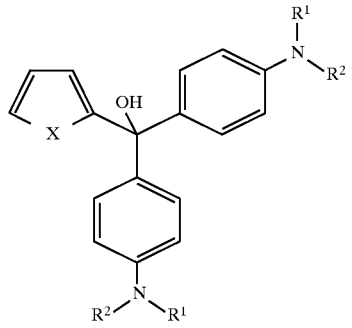

wherein;

each $R^1$ and $R^2$ is each independently selected from: alkyl groups of up to 20 carbon atoms, alkenyl groups of up to 20 carbon atoms, and aryl groups of up to 14 carbon atoms; or $R^1$ and $R^2$ of each $NR^1R^2$ group may represent the necessary atoms to complete a 5-, 6-, or 7-membered heterocyclic ring group; or one or more $R^1$ and $R^2$ of each $NR^1R^2$ group may represent the atoms necessary to complete a 5- or 6-membered heterocyclic ring group fused to the phenyl ring on which the $NR^1R^2$ group is attached;

X is O, S, or N—$R^3$, and $R^3$ is selected from alkyl groups of up to 20 carbon atoms, alkenyl groups of up to 20 carbon atoms, and aralkyl groups of up to 20 carbon atoms. Preferably, $R^1$ and $R^2$ are alkyl groups of up to 10 carbon atoms. Preferably, $R^3$ is an alkyl group of up to 10 carbon atoms. The 2,5-bis-[bis[(4-amino) phenyl]hydroxymethyl]substituted furan, thiophene and pyrrole color-forming compound preferably has the general formula 1.

Also included as an aspect of this invention is a substrate with at least one surface having a coating comprising microcapsules which contain a composition comprising a color-forming compound selected from the group consisting of 2-mono-[bis[(4-amino)phenyl]hydroxymethyl] substituted furan, thiophene and pyrrole compounds and 2,5-bis-[bis[(4-amino)phenyl]hydroxymethyl]substituted furan, thiophene and pyrrole color-forming compounds. Preferably the composition in the microcapsules also comprises a solvent.

The invention also includes an imaging construction comprising a first substrate having a front and back surface, coated on at least one of the front and back surfaces of the first substrate, a color-forming compound selected from the group consisting of 2-mono-[bis[(4-amino)phenyl] hydroxymethyl]substituted furan, thiophene and pyrrole compounds and 2,5-bis-[bis[(4-amino)phenyl] hydroxymethyl]substituted furan, thiophene and pyrrole color-forming compounds, a developer, and a means for separating the color-forming compound from the developer until the construction is subjected to activating pressure.

Preferably, the construction comprises a first substrate having a front and back surface;

coated on the back surface of the first substrate, a color-forming compound selected from the group consisting of 2-mono-[bis[(4-amino)phenyl]hydroxymethyl] substituted furan, thiophene, and pyrrole compounds and 2,5,-bis[bis[(4-amino)phenyl]hydroxymethyl] substituted furan, thiophene, and pyrrole color-forming compounds;

a second substrate having a front and back surface;

coated on the front surface of the second substrate, a developer compound; and means for separating the color-forming compound from the developer until the construction is subjected to activating pressure. In this construction, the first and second substrates are positioned so that the back of the first substrate contacts the front surface of the second substrate. The construction may also comprise additional substrates that have front and back surfaces, the back surface being coated with the color-forming compound and the front surface being coated with the developer. These substrates are positioned between the first and second substrates in such a manner that a surface bearing a color-forming compound on one substrate contacts a surface bearing a developer on another substrate. This imaging construction may be referred to as a form-set carbonless imaging construction employing CB and CF sheets and optionally CFB substrates or sheets.

Alternatively, the imaging construction comprises:

a first substrate having a front and back surface;

a second substrate having a front and back surface;

coated on the front surface of the second substrate, a color-forming compound selected from the group consisting of 2-mono-[bis[(4-amino)phenyl] hydroxymethyl]substituted furan, thiophene, and pyrrole compounds and 2,5,-bis[bis[(4-amino)phenyl] hydroxymethyl]substituted furan, thiophene, and pyrrole color-forming compounds; and a developer compound; and means for separating the color-forming compound from the developer until the construction is subjected to activating pressure. In this construction, the first and second substrates are positioned so that the back of the first substrate contacts the front surface of the second substrate. The construction may also comprise additional substrates that have front and back surfaces, the front surface being coated with both the color-forming compound and the developer. These substrates are positioned between the first and second substrates in such a manner that a surface bearing a color-forming compound and developer on one substrate contacts the back surface on another substrate. This imaging construction may be referred to as a form-set carbonless imaging construction employing self-contained (SC) substrates or sheets.

In both constructions, the preferred means for separating the color-forming compound from the developer is by locating one of the reactants, preferably the color-forming compound, within a pressure-rupturable microcapsule.

The invention also includes within its scope a method of forming an image comprising providing an imaging construction as described above and applying pressure to the imaging construction thereby enabling the color-forming compound and the developer to react to form a colored image.

An alternative method of forming an image within the scope of this invention comprises providing an imaging construction comprising a substrate, a color-forming compound selected from the group consisting of 2-mono-[bis[(4-amino)phenyl]hydroxymethyl]substituted furan, thiophene and pyrrole compounds and 2,5-bis-[bis[(4-amino)phenyl]hydroxymethyl]substituted furan, thiophene and pyrrole color-forming compounds, and an acidic developer, and applying heat to the construction in an imagewise manner thereby causing the color-forming compound to react with the developer to create a colored image. The thermographic imaging construction used to form this image by the application is also within the scope of this invention.

As used herein:

The term "activating pressure" means a pressure sufficient to cause the color-former to contact and react with the developer.

When a general structure is referred to as "a compound having the central nucleus" of a given formula, any substitution which does not alter the bond structure of the formula or the shown atoms within that structure is included within the formula. For example, in compounds of structure 1 and 2 substituent groups may be placed on the aromatic rings, but the basic structure shown may not be altered and the atoms shown in the structure may not be replaced. When a general structure is referred to as "a general formula" it does not specifically allow for such broader substitution of the structure.

$R^1$, $R^2$, and $R^3$ in the foregoing-disclosed formulae may contain additional substituent groups. As is well understood in this area, substitution is not only tolerated, but is often advisable and substitution is anticipated on the compounds used in the present invention. As a means of simplifying the discussion and recitation of certain substituent groups, the terms "group" and "moiety" are used to differentiate between those chemical species that may be substituted and those which may not be so substituted. Thus, when the term "group," such as "aryl group," is used to describe a substituent, that substituent includes the use of additional substituents beyond the literal definition of the basic group. Where the term "moiety" is used to describe a substituent, only the unsubstituted group is intended to be included. For example, the phrase, "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy, etc. For example, alkyl group includes ether groups (e.g., $CH_3$—$CH_2$—$CH_2$—O—$CH_2$—), haloalkyls, nitroalkyls, carboxyalkyls, hydroxyalkyls, sulfoalkyls, etc. On the other hand, the phrase "alkyl moiety" is limited to the inclusion of only pure hydrocarbon alkyl chains, such as methyl, ethyl, propyl, t-butyl, cyclohexyl, iso-octyl, octadecyl, and the like. Substituents that react with active ingredients, such as very strongly electrophilic or oxidizing substituents, would of course be excluded by the ordinarily skilled artisan as not being inert or harmless.

Other aspects, advantages, and benefits of the present invention are apparent from the detailed description, examples, and claims.

DETAILED DESCRIPTION OF THE INVENTION

The Color-Forming Compounds

Representative 2-mono-[bis[(4-amino)phenyl] hydroxymethyl]substituted furan, thiophene and pyrrole and 2,5-bis-[bis[(4-amino)phenyl]hydroxymethyl]substituted furan, thiophene, and pyrrole color-forming compounds useful in the present invention are shown below. Preparation for these compounds are described later herein. These representations are exemplary and are not intended to be limiting.

Compound 1a

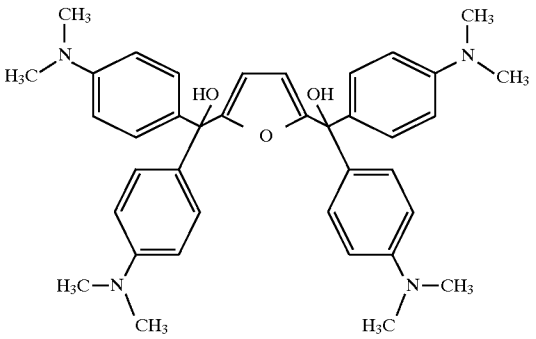

Compound 1b

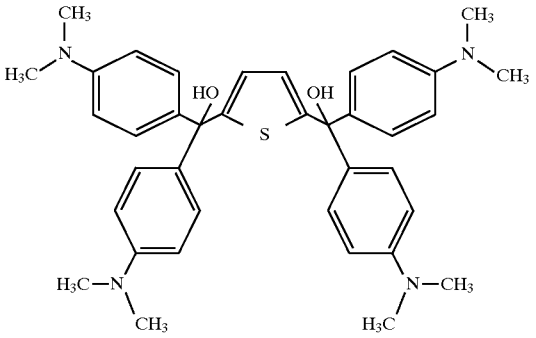

Compound 1c

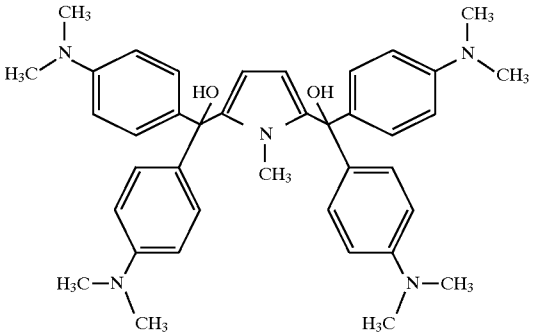

Compound 2a

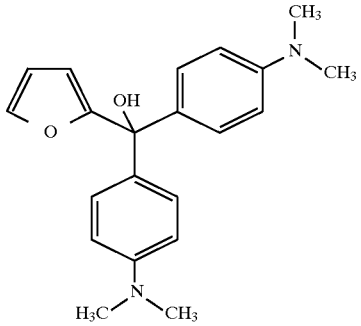

Compound 2b

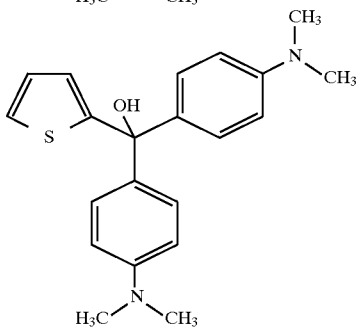

-continued

Compound 2c

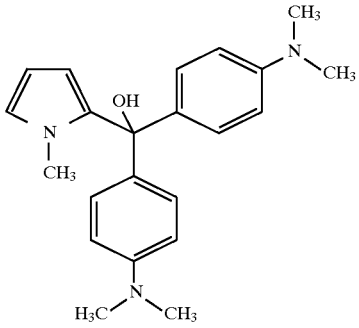

The 2-mono-[bis[(4-amino)phenyl]hydroxymethyl] substituted furan, thiophene, and pyrrole compounds and 2,5-bis-[bis[(4-amino)phenyl]hydroxymethyl]substituted furan, thiophene, and pyrrole color-forming compounds are generally colorless to lightly colored, and impart little or no color to the substrates upon which they are coated. In addition, these compounds rapidly form stable, intense colors upon reaction with the developer systems typically used in carbonless papers. Finally, the 2-mono-[bis[(4-amino) phenyl]hydroxymethyl]substituted furan, thiophene and pyrrole compounds and 2,5-bis-[bis[(4-amino)phenyl] hydroxymethyl]substituted furan, thiophene and pyrrole color-forming compounds satisfy the requirements of solubility in suitable solvents for encapsulation, non-solubility in aqueous media, non-reactivity with fill solvents, and color-forming compounds mixed therewith, and compatibility with existing carbonless paper developer systems.

In some instances a mixture of color-forming compounds may be used and images of varying colors can be formed by the reaction between a developer and the color-forming compounds. Appropriate mixtures to form black images are particularly useful. In systems where the color-forming compounds are encapsulated, the system may provide either one type of capsule containing a mixture of color-forming compounds or may comprise a mixture of capsules, each containing a separate encapsulated color-forming compound solution. In the latter instance, color is formed by the mixing of the color-forming compounds upon capsule rupture and reaction with the developer.

The color-forming compounds of this invention are preferably encapsulated by means of interfacial polymerization encapsulation. The encapsulation process requires the color-forming compound be dissolved in a solvent or mixed solvents. Thus, the preferred 2-mono-[bis[(4-amino)phenyl] hydroxymethyl]substituted furan, thiophene, and pyrrole and 2,5-bis-[bis[(4-amino)phenyl]hydroxymethyl] substituted furan, thiophene, and pyrrole color-forming compounds must be soluble in the solvents used in the encapsulation process. These solvents become the fill solvents. Such solvents are aqueous immiscible solvents and include but are not limited to xylene, toluene, cyclohexane, diethyl phthalate, tributyl phosphate, benzyl benzoate, diethyl adipate, butyl diglyme, and the like. Preferably, the color-forming compound is present in the microcapsules in an amount from about 0.2 to about 10% by weight based on weight of the fill of the microcapsule.

Preparation of the Color-Forming Compounds

The 2-mono-[bis[(4-amino)phenyl]hydroxymethyl]-substituted furan, thiophene and pyrrole compounds and 2,5-bis-[bis[(4-amino)phenyl]hydroxymethyl]-substituted furan, thiophene, and pyrrole compounds disclosed in this application can be synthesized by mono- and di- lithiation of a furan, thiophene, and pyrrole compound, respectively, and subsequent reaction with an appropriate ketone.

Compounds 2a, 2b, and 2c have been prepared via lithiation of furan, thiophene, and N-methylpyrrole and reaction with Michler's ketone. The effect of these compounds on *Trypanosoma cruzi* and their $^{13}C$ NMR spectra have been reported. See, C. de Diago and C. Avendano, *Chem. Scri.* 1988, 28, 403–409; C. de Diago, C. Avendano, A. Alcina, L. Carrasco, and J. Elguero, *An. Trop. Med. Parasitol.,* 1988, 82(3), 235–241; and C. Avendano, C. de Diago, and J. Elguero, *Mag. Reson. Chem.* 1990, 28(12), 1101–1107.

Dilithiations of furan, thiophene and N-methylpyrrole and subsequent reactions with a bis[diaminophenyl] ketone, such as Michler's ketone (4,4'-bis(dimethylamino) benzophenone), furnish a new class of 2,5-bis-[bis[(4-amino)phenyl]hydroxymethyl]-substituted five-membered heteroaromatic compounds. These compounds as well as -mono-[bis[(4-amino)phenyl]hydroxymethyl]-substituted furan, thiophene, and pyrrole compounds can be used as color-forming compounds in imaging constructions.

Treatment of furan 3a with two equivalents of butyllithium in the presence of two equivalents of tetramethylethylenediamine at −30° C. for 15 minutes followed by refluxing in hexane for 30 minutes and subsequent quenching with Michler's ketone afforded the desired product 1a in 42% yield. Compounds 1b and 1c were similarly prepared in 55% and 63% yields, respectively. Compounds 1a–c are sparingly soluble in common organic solvents such as chloroform, acetone and ethyl acetate and were thus purified by boiling in ethyl acetate and filtering the deposit.

purified by recrystallization from a mixture of ethyl acetate and hexane (2:1). The structures of all compounds prepared were confirmed by $^{1}H$ and $^{13}C$ nmr spectroscopy and elemental analyses.

Carbonless Imaging Constructions

The 2-mono-[bis[(4-amino)phenyl]hydroxymethyl]-substituted furan, thiophene, and pyrrole compounds and 2,5-bis-[bis[(4-amino)phenyl]hydroxymethyl]-substituted furan, thiophene, and pyrrole compounds may be used in both self-contained and CB/CF carbonless paper constructions.

A preferred construction comprises the encapsulated color-forming compounds dissolved in an appropriate solvent or solvents within microcapsules. The microcapsules are coated onto a back side of a donor sheet, preferably in a suitable binder. The developer, optionally in a suitable binder, is coated onto a front side of a mating, or receptor, sheet. In imaging, the two sheets are positioned such that the back side of donor sheet faces the developer coating on the front side of the receptor sheet. To create a form-set, the two sheets are secured to each other such as by an adhesive along one edge. When activating pressure is applied to front side of the donor sheet, the capsules rupture and release the color-forming compound for transfer to the receptor sheet, forming a colored pattern due to reaction with the acidic developer. If desired one or more additional substrates that are coated on one side with a developer and coated on the other side with the color-forming compound may be used between the previously mentioned donor and receptor sheets.

Scheme 1

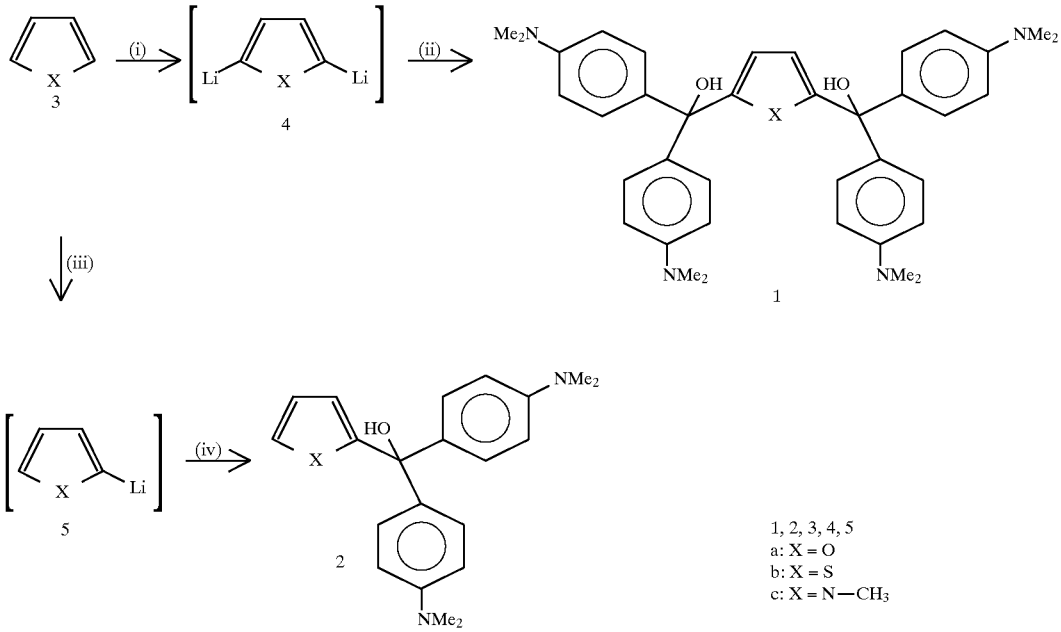

(i) 2 BuLi, 2 TMEDA; in hexane, −30° C. for 15 minutes then reflux for 30 minutes.
(ii) Michler's ketone; −30° C. for 15 minutes then 20° C. overnight.
(iii) 1 BuLi, 1 TMEDA; in hexane, −30° C. for 15 minutes then reflux for 30 minutes.
(iv) Michler's ketone; −30° C. for 30 minutes then 20° C. overnight.

In the above-mentioned procedure, the mono-substituted products 2a–c were obtained in 30–60% yields when only one equivalent of butyllithium was used. Unlike the 2,5-disubstituted derivatives, compounds 2a–c show high solubility in chloroform, acetone and ethyl acetate, and can be When used in a carbonless copy-paper construction, a substrate is coated with a slurry comprising microcapsules filled with a color-forming compound of structure 1 or 2, (or mixtures thereof) dissolved in a suitable fill solvent or solvents, preferably a hydrophobic solvent such that the solution is water-insoluble. The shell of the capsules are preferably a water-insoluble polyurea formed by polymerization of a polyisocyanate and a polyamine. The capsule slurry, may also be combined with a binding agent, such as aqueous sodium alginate, starch, latex, or mixtures thereof for coating on one face of the substrate. In a preferred embodiment, the back of the donor sheet is coated with the capsule slurry, and is referred to as the coated back (CB) sheet.

Alternatively, a composition comprising the color-forming compounds of the present invention in a solvent can be carried by a variety of materials such as woven, non-woven or film transfer ribbons for use in impact marking systems such as typewriters and the like, whereby the color-forming compound is transferred to a record surface containing a developer by impact transfer means. Further, a composition comprising the color-forming compound and a solvent can be absorbed in a porous pad for subsequent transfer to a coreactive record surface by transfer means such as a portion of the human body, e.g., a finger, palm, foot or toe, for providing fingerprints or the like.

Electron acceptors, e.g. Lewis acids, may be used as developers for the color-forming compounds. Examples of such developers are activated clay substances, such as attapulgite, acid clay, bentonite, montmorillonite, acid-activated bentonite or montmorillonite, zeolite, hoalloysite, silicon dioxide, aluminum oxide, aluminum sulfate, aluminum phosphate, hydrated zirconium dioxide, zinc chloride, zinc nitrate, activated kaolin or any other clay. Acidic, organic compounds are also useful as developers. Examples of these compounds are ring-substituted phenols, resorcinols, salicylic acids, such as 3,5-bis(α,α-dimethylbenzyl)salicylic or 3,5-bis(α-methylbenzyl) salicylic acid, or salicyl acid esters and metal salts thereof, for example zinc salts, and an acidic, polymeric material, for example a phenolic polymer, an alkylphenolacetylene resin, a maleic acid/colophonium resin or a partially or fully hydrolyzed polymer of maleic anhydride with styrene, ethylene or vinyl methyl ether, or carboxymethylene. Mixtures of the monomeric and polymeric compound mentioned may also be used. Preferred developers are Lewis acids, salicylic acids and particularly zincated salicylic acids, phenolic compounds and particularly zincated phenolic resins, and acidic clays.

Thermographic Imaging Elements

The 2-mono-[bis[(4-amino)phenyl]hydroxymethyl]-substituted furan, thiophene, and pyrrole compounds and 2,5-bis-[bis[(4-amino)phenyl]hydroxymethyl]-substituted furan, thiophene, and pyrrole compounds are also useful color-forming compounds for thermographic imaging elements. Such elements are imaged by applying heat in an imagewise manner. Thermographic imaging elements generally comprise a substrate, a color-forming compound, and electron acceptor developer, and optionally a binder. The color-forming compound may be dissolved and dispersed in a binder coating on the substrate and the developer dissolved or dispersed in a second coating. Alternatively, the color-forming compound and the developer may be dispersed in one coating. The binder softens in areas where heat is applied enabling the color-forming compound to come into contact with the developer.

The thermographic imaging element can be prepared by dissolving or dispersing the color-forming compound, the developer, the binder, and optional additives, in an inert solvent, such as, for example, water. Thermographic solutions or dispersions used in this invention can be coated by various coating procedures including wire wound rod coating, dip coating, air knife coating, curtain coating, or extrusion coating. Typical wet thickness of the solution or dispersion layer can range from about 10 to about 100 micrometers (μm), and the layer can be dried in forced air at temperatures ranging from 20° C. to 100° C. It is preferred that the thickness of the layer be selected to provide images which give good color upon development.

Suitable binders include water-soluble or water swellable binders including but not limited to hydrophilic polymers, such as polyvinyl alcohol, polyacrylic acid, hydroxyethylcellulose, methylcellulose, carboxymethylcellulose, polyacrylamide, polyvinylpyrrolidone, carboxylated butadiene-styrene copolymers, gelatins, starch or etherified maize starch. If the color-forming compound and the developer are present in two separate coatings, water insoluble binders, such as natural or synthetic rubber, polystyrene, styrene-butadiene copolymers, polymethyl acrylates, ethylcellulose, nitrocellulose, etc. may be used.

Suitable developers include the same electron acceptors used in pressure-sensitive papers. Examples of developers are the above mentioned clay minerals and phenolic resins or phenolic compounds such as 4-tert-butylphenol, 4-phenylphenol, methylene-bis(p-phenylphenol), 4-hydroxydiphenyl ether, α-naphthol, β-napthol, methyl or benzyl 4-hydroxybenzoates, 4-hydroxydiphenyl sulfone, 4-hydroxyacetophenone, 2,2'-dihydroxydiphenyl, 4,4'-cyclohexylidenephenol, 4,4'-isopropylidenediphenol, 4,4'-isopropylidenebis(2-methylphenol), a pyridine complex of zinc thiocyanate, 4,4-bis(4-hydroxyphenyl)valeric acid, hydroquinone, pyrogallol, phoroglucine, p-, m-, and o-hydroxybenzoic acid, gallic acid, 1-hydroxy-2-naphthoic acid and boric acid or organic, preferably aliphatic, dicarboxylic acids, for example tartaric acid, oxalic acid, maleic acid, citric acid, citraconic acid or succinic acid.

Determination of Color

In general, the colors formed by reaction of the color-forming compound and developer in the Examples below, were determined by preparing a 1% solution of the color-forming compound or mixture of color-forming compounds in an appropriate solvent. Unless otherwise indicated, the solvent was composed of a mixture of diethyl phthalate (50.0%), and cyclohexane (50.0%). The images were formed by applying two stripes of the solution to a 3M Scotchmark™ CF developer (receptor) sheet using a cotton tipped applicator swab. This sheet contains a zincated phenolic resin (an alkyl Novolak™ resin) as the Lewis acid developer. Rapid and complete development of the image was achieved by passing the sheet through a hot shoe adjusted to 102° C., making a revolution every 10 seconds. The visually observed colors were measured and recorded.

One method of color measurement is to determine the color's position in color space. One color space system is the CIELAB System; see F. W. Billmeyer, Jr., and M. Saltzman, *Principles of Color Technology;* John Wiley & Sons; New York, N.Y.; Ch. 2 & 3, 1981. In this system three mutually perpendicular axes (L*, a*, and b*) are needed to define a color. "L*" (+z axis) represents the lightness or darkness of the image (L of 100 is white, L of 0 is black); "a*" (x axis) represents the amount of red or green (+a* is red, −a* is green); and "b*" (y axis) represents the amount of yellow or blue (+b* is yellow, −b* is blue). By measuring a material's L*, a*, and b* values, the color of one sample can be compared with that of other samples.

Because the color of a sample is also dependent upon the color temperature of the illuminating source, the angle at which the sample is illuminated, the angle at which the illumination is reflected, and the angle of the retina illuminated, these all need to be specified. Many instruments have been developed to record these values. One such instrument is the Gretag SPM-100 Spectrophotometer. This instrument is capable of automatically determining the L*, a*, and b* values for a given sample, and was used for the following examples.

The L*, a*, and b* color coordinates of the more uniform stripe were measured on a Gretag SPM-100 Spectrophotometer using no color filters, a standard Observer of 2°; and using illuminant D-50. The sample was illuminated at 45° and read at 0°. The observed (image) color and the CIELAB coordinates for the developed color-forming compounds of this invention are given for each sample.

Imaging Evaluation of Coated CB Sheets

Tests were performed on coated CB sheets to determine their characteristics and acceptability for use. These tests include evaluation of imaging speed, and ultimate image density. Imaging speed measures the time to achieve an image acceptable for viewing and is controlled by the kinetics of the imaging reaction, while ultimate image density measures the image after complete reaction and is a measure of the thermodynamics of the imaging reaction.

Imaging speed is determined by passing a CB and a CF sheet under a steel roller with an impact pressure of approximately 350 pli (pressure per linear inch) and measuring the reflectance of the resultant image four seconds after imaging. A Photovolt Model 670 Reflectance Meter with a model 610 search unit fitted with a green filter was used. This instrument is available from Seragen Diagnostics, Inc. A presently sold product such as 3M Brand Carbonless Paper has an imaging speed of 35 to 40. In interpreting the reflectance numbers, a high number indicates high reflectance, and a low number indicates low reflectance. Thus a white surface would have a reflectance of close to 100, and a black surface would have a reflectance approaching zero. A "slower" imaging system would be expected to have a greater (higher number) reflectance after 4 seconds than a faster imaging system.

Ultimate image reflectance was also measured using the Photovolt Model 670 Reflectance Meter. Subsequent to image formation the imaged sheet was heated to 102° C. for 7 seconds to fully develop the image, and the reflectance was measured. A presently sold product such as 3M B/P Brand Carbonless Paper has an ultimate image reflectance of 24 to 28.

EXAMPLES

All materials used in the following examples are readily available from standard commercial sources such as Aldrich Chemical Co. (Milwaukee, Wis.) unless otherwise specified. The following additional terms and materials were used.

Melting points were determined with a Kofler hot stage apparatus and are uncorrected. $^{1}H$ nmr and $^{13}C$ nmr spectra were recorded on a Varian VXR 300 MHz spectrometer in deuterochloroform using tetramethylsilane as an internal reference for $^{1}H$ spectra and deuterochloroform for $^{13}C$ spectra. Elemental analyses were performed on a Carlo Erba-1106 instrument.

Color measurements were made on a Gretag SPM-100 Spectrophotometer. This instrument is available from Gretag Aktiengesellschaft, Regensdorf Switzerland.

All percentages are by weight unless otherwise indicated.

Mondur™ MRS (CAS No. 9016-87-9) is a polymethylenepolyphenylenepolyisocyanate and is available from Bayer Chemical Company, Pittsburgh, Pa.

Pergascript Red I-6B, Pergascript Orange I-5R, and Pergascript Black I-R are fluoran color-forming compounds available from Ciba-Geigy, Greensboro, N.C.

Sodium alkylnaphthalenesulfinate dispersant was obtained from Emkay Chemical Co., Elizabeth, N.J.

Sure Sol™ 290 [CAS RN 81846-81-3] is a 4,4'-bis-butylated-1,1'-biphenyl and is available from Koch Refining Co., Corpus Christi, Tex.

Tetraethylenepentamine was obtained from Aldrich Chemical Co., Milwaukee, Wis.

General procedure for the preparation of compounds 1a–c and 2a–c

To a solution of furan, thiophene, or N-methylpyrrole (20 mmol) and tetramethylethylenediamine (40 mmol) in hexane (20 mL) at −30° C. was added butyllithium (40 mmol for 1a–c, 20 mmol for 2a–c). The solution was kept at this temperature for 15 minutes, refluxed for 30 minutes then cooled at −30° to −50° C. A solution of 4,4'-bis(dimethylamino)benzophenone (40 mmol for 1a–c, 20 mmol for 2a–c) in THF (200 mL) was then added, and the mixture stirred at room temperature overnight. After adding water (50 mL), the mixture was extracted with ethyl acetate (3×120 mL). The combined extracts were dried over magnesium sulfate and the solvent evaporated to give a residue. In the cases of 1a–c, 2a and 2c, pure products were obtained upon boiling this residue in ethyl acetate (~80 mL) and filtering the deposit. Product 2b was purified by column chromatography on silica gel (hexane:ethyl acetate=3:1).

Preparation of 2,5-Bis-[bis(p-dimethylaminophenyl) hydroxymethyl]furan (1a)

This compound was obtained in 42% yield, mp 186°–188° C.; $^{1}H$ nmr δ2.88 (s, 24 H), 5.60 (br, 2 H), 5.77 (s, 2 H), 6.58 (d, 8 H, J=8.7 Hz), 7.10(d, 8 H, J=8.5 Hz); $^{13}C$ nmr δ 40.1, 76.1, 107.5, 111.0, 127.7, 134.1, 148.9, 159.1.

Anal. Calcd. for $C_{38}H_{44}N_4O_3$: C, 75.45; H, 7.34; N, 9.27.

Found: C, 75.34; H, 7.40; N, 9.26.

Preparation of 2,5-Bis-[bis(p-dimethylaminophenyl) hydroxymethyl]thiophene (1b)

This compound was obtained in 55% yield, mp 194°–196° C.; $^{1}H$ nmr δ 2.82 (s, 24 H), 6.12 (s, 2 H), 6.42 (s, 2 H), 6.61 (d, 8 H, J=8.8 Hz), 7.20 (d, 8 H, J=8.5 Hz); $^{13}C$ nmr δ 40.2, 78.2, 111.2, 124.2, 127.9, 136.1, 149.1, 153.3.

Anal. Calcd. for $C_{38}H_{44}N_4O_2S$: C, 73.51; H, 7.15; N, 9.03.

Found: C, 73.29; H, 7.23; N, 8.92.

Preparation of 2,5-Bis-[bis(p-dimethylaminophenyl) hydroxymethyl]N-methylpyrrole (1c)

This compound was obtained in 63% yield, mp 204°–206° C.; $^{1}H$ nmr δ 2.88 (s, 24 H), 3.08 (s, 3 H), 5.03 (s, 2 H), 5.70 (s, 2 H), 6.58 (d, 8 H, J=7.5 Hz), 7.05 (d, 8 H, J=7.32 Hz); $^{13}C$ nmr δ 34.2, 40.1, 76.9, 107.8, 127.8, 135.5, 148.5.

Anal. Calcd. for $C_{39}H_{47}N_5O_2$: C, 75.81; H, 7.67; N, 11.34.

Found: C, 75.54; H, 7.68; N, 11.34.

Preparation of 2-Bis-(p-dimethylaminophenyl) hydroxymethyl]furan (2a)

This compound was obtained in 60% yield, mp 107°–110° C.; $^1$H nmr δ 2.89 (s, 12 H), 5.88–5.94 (m, 1 H), 6.22–6.28 (m, 1 H), 6.64 (d, 4 H, J=8.2 Hz), 7.13 (d, 4 H, J=7.9 Hz), 7.34 (s, 1 H); $^{13}$C nmr δ 40.4, 77.4, 108.6, 109.7, 111.7, 128.0, 133.2, 142.0, 142.0, 149.6, 159.2.

Anal. Calcd. for $C_{21}H_{24}N_2O_2$: C, 74.96; H, 7.19; N, 8.33. Found: C, 74.87; H, 7.10; N, 8.21.

Preparation of 2-Bis-(p-dimethylaminophenyl) hydroxymethyl]thiophene (2b)

This compound was obtained in 30% yield, mp 50° C.; $^1$H nmr δ 2.92 (s, 12 H), 6.64 (d, 4 H, J=9.0 Hz), 6.69–6.71 (m, 1 H), 6.89–7.01 (m, 1 H), 7.17–7.23 (m, 5 H); $^{13}$C nmr δ 40.5, 79.7, 111.6, 124.9, 126.0, 126.1, 129.2, 128.1, 135.2, 149.6, 153.8.

Preparation of 2-Bis-(p-dimethylaminophenyl) hydroxymethyl]-N-methylpyrrole (2c)

This compound was obtained in 30% yield, mp 154°–156° C.; $^1$H nmr δ 2.91 (s, 12 H), 3.40 (s, 3 H), 5.49–5.51 (m, 1 H), 5.92–5.94 (m, 1 H), 6.58–6.59 (m, 1 H), 6.65 (d, 4 H, J=8.9 Hz), 7.08 (d, 4 H, J=8.9 Hz); $^{13}$C nmr δ 35.8, 35.9, 40.5, 78.1, 105.2, 111.7, 124.2, 127.9, 134.6, 137.4, 149.4.

Anal. Calcd. for $C_{22}H_{27}N_3O$: C, 75.60; H, 7.79; N, 12.03. Found: C, 75.20; H, 7.79; N, 11.66.

Example 1

A 1% solution of each of color-forming compounds 1a–c and 2a–c was prepared in a mixture of diethylphthalate:cyclohexane (1:1). Each solution was swabbed onto a sheet of 3M Scotchmark™ CF paper using a cotton tipped applicator swab. This CF sheet contains a zincated phenolic resin as the developer. In all cases, an immediate reaction occurred. The following colors were obtained:

| Color-Former | Image Color | L* | a* | b* |
|---|---|---|---|---|
| 1a | Blue | 37.73 | 3.86 | −22.83 |
| 1b | Blue-black | 45.84 | 7.47 | −31.43 |
| 1c | Cyan | 42.85 | 1.53 | −30.30 |
| 2a | Green-yellow | 64.17 | −22.28 | 6.88 |
| 2b | Green | 58.87 | −39.15 | 5.91 |
| 2c | Blue | 40.95 | 0.41 | −45.26 |

Example 2

The following Example demonstrates that compounds of this invention can be encapsulated and coated to prepare a carbonless paper form-set construction.

Encapsulation of Compound 1b

A capsule fill solution was prepared by placing 1.5 g of color-forming compound 1b and 290.50 g of Sure Sol™ 290 into an Ehrlenmeyer flask. Stirring was begun and the mixture heated to ensure complete dissolution of the color-forming compound. Upon dissolution, the solution was allowed to slowly cool to room temperature and 8.0 g of Mondur™ MRS was added. The total color-forming compound concentration was 0.5 wt %.

This fill solution was added to a stirred solution of 492.97 g of water, 10.3 g of sodium alkylnaphthalenesulfinate dispersant, and a sufficient amount of 50% NaOH solution to bring the pH to 11.00. The flask was then placed in a water bath maintained at 70° F. (21.1° C.). When the solution had warmed, 20 g of a 25% solution of tetraethylene pentamine in water was added dropwise over 1 hr. Polyurea capsules containing color-forming compound 1b were formed.

The capsules obtained were spherical with a median volumetric diameter of 21.5 μm. The capsule dispersion contained approximately 34.77% capsules.

Various amounts of capsule slurry were added to 65 g of a 1.5% aqueous sodium alginate solution. The mixture was applied to a coated paper using a bar coater with a 3 mil (76.2 mm) gap. The coating was allowed to dry at room temperature.

The coated CB sheet was imaged using a 3M Scotchmark™ CF sheet containing a zincated phenolic resin as the developer. Image color, speed, ultimate image reflectance, and L*, a*, and b* were determined as described above. The L*, a*, b* values for this Example are slightly different from those of Example 1 above as the concentrations of color-forming compound are different.

| Amount capsule slurry | Image Color | Speed | Ultimate | L* | a* | b* |
|---|---|---|---|---|---|---|
| 10 g | Blue | 65.2 | 41.9 | 71.66 | 0.45 | −14.59 |
| 15 g | Blue | 62.7 | 35.3 | 69.25 | 1.03 | −16.58 |
| 20 g | Blue | 61.1 | 32.7 | 64.89 | 1.50 | −18.38 |
| 25 g | Blue | 59.8 | 31.5 | 63.93 | 1.79 | −18.98 |

Example 3

The following Example demonstrates the use of the color-forming compounds of this invention in combination with fluoran color-forming compounds to provide blue-black image. Fluoran color-forming compounds develop by the opening of a lactone ring. A 1% solution of a mixture of color-forming compounds was prepared in a mixture of diethylphthalate/cyclohexane (1:1). The color-forming compound solution had the following composition:

| Compound | wt % |
|---|---|
| Compound 1b | 16% |
| Compound 2b | 22% |
| Pergascript Red I-6B | 8% |
| Pergascript Orange I-5R | 5% |
| Pergascript Black I-R | 49% |

The solution was swabbed onto a sheet of 3M Scotchmark™ CF paper using a cotton tipped applicator swab. This CF sheet contains a zincated phenolic resin as the developer. An immediate reaction occurred to form a black image.

| Example | Image Color | L* | a* | b* |
|---|---|---|---|---|
| 3 | Black | 54.39 | 2.77 | 4.64 |

Example 4

The following Example demonstrates the use of the color-forming compounds of this invention in a fingerprinting system. An index finger was placed lightly onto a piece of filter paper saturated with the 1% solution of a mixture of color-forming compounds of Example 3. The finger was then pressed against a sheet of 3M Scotchmark™ CF paper. A reaction occurred to form a dark black fingerprint.

Example 5

The following Example further demonstrates the use of the color-forming compounds of this invention in combination with fluoran color-forming compounds to provide blue-black image. A 1% solution of a mixture of color-forming compounds was prepared in a mixture of diethylphthalate-:cyclohexane (1:1). The color-forming compound solution had the following composition:

| Compound | wt % |
|---|---|
| Compound 1b | 32% |
| Compound 2b | 44% |
| Pergascript Red I-6B | 16% |
| Pergascript Orange I-5R | 8% |

The solution was swabbed onto a sheet of 3M Scotchmark™ CF paper using a cotton tipped applicator swab. This CF sheet contains a zincated phenolic resin as the developer. A reaction occurred to form a dark blue-black image.

| Example | Image Color | L* | a* | b* |
|---|---|---|---|---|
| 5 | Blue-black | 48.93 | 7.04 | −23.51 |

Example 6

The following Example demonstrates the use of the color-forming compounds of this invention in a fingerprinting system. An index finger was placed lightly onto a piece of filter paper saturated with the 1% solution of a mixture of color-forming compounds of Example 5. The finger was then pressed against a sheet of 3M Scotchmark™ CF paper. An immediate reaction occurred to form a dark blue-black fingerprint.

Example 7

The following example demonstrates the use of the color-forming compounds of this invention in a thermal imaging element.

An aqueous slurry of 1.00 g of color-forming compound 1b, 3.00 g of styrene maleic anhydride resin (Stymer S), and 96 g of water was ball milled for 24 hours.

A thermal imaging dispersion was prepared by mixing the materials shown below.

| Component | Wet Weight - g | Dry Weight - g |
|---|---|---|
| Water | 40.0 | — |
| Rice Starch | 7.20 | 7.20 |
| Cellosize QPO9-L (7%) | 16.26 | 1.38 |
| Stymer S (25%) | 16.26 | 2.85 |
| Standapol ES (28%) | 0.11 | 0.03 |
| Bisphenol A (30%) | 24.54 | 7.36 |
| Slurry of 1b (1.75%) | 6.00 | 0.10 |
| Total | 105.52 | 18.92 |

Rice starch is available from Sigma Chemical Co., St. Louis, MO. 63178.
Cellosize QPO9-L is available from the Specialty Chemical Division of Union Carbide, Danbury, CT 06817.
Stymer S is the sodium salt of a styrene-maleic anhydride resin. It is available from Monsanto.
Standapol ES-3 is an anionic surfactant used as a dispersing agent. It is available from Henkel Inc., Teaneck, NJ 07666.

The dispersion was coated using a wire wound rod (Meier bar) onto bond paper and dried. The thermographic element was imaged using the tip of a heated screwdriver to simulate a thermal print head. A strong blue image resulted.

Reasonable modifications and variations are possible from the foregoing disclosure without departing from either the spirit or scope of the present invention as defined by the claims.

What I claim is:

1. An imaging construction comprising:

a first substrate having a front and back surface;

coated on at least one of the front and the back surfaces of the first substrate, a color-forming compound selected from the group consisting of 2-mono-[bis[(4-amino)phenyl]hydroxymethyl]substituted furan, thiophene and pyrrole compounds and 2,5-bis-[bis[(4-amino)phenyl]hydroxymethyl]substituted furan, thiophene and pyrrole color-forming compounds;

a developer; and a means for separating the color-forming compound from the developer until the construction is subjected to activating pressure.

2. The imaging construction of claim 1 wherein the means for separating the color-forming compound from the developer comprises locating one of the color-forming compound or the developer within a pressure-rupturable microcapsule.

3. The imaging construction of claim 1 wherein the color-forming compound is located within the pressure-rupturable microcapsule.

4. The imaging construction of claim 1 further comprising a second substrate having a first and a second surface, wherein the color-forming compound is coated on the back surface of the first substrate and the developer is coated on the front surface of the second substrate and the first and second substrates are positioned so that the back surface of the first substrate contacts the front surface of the second substrate.

5. The imaging construction of claim 4 further comprising at least one additional substrate having a front and back surface, the back surface being coated with the color-forming compound and the front surface being coated with the developer, wherein the at least one additional substrate is positioned between the first and second substrates in such a manner that a surface bearing a color-forming compound on one substrate contacts a surface bearing a developer on another substrate.

6. The construction of claim 1 wherein the color-forming compound is represented by the general formula:

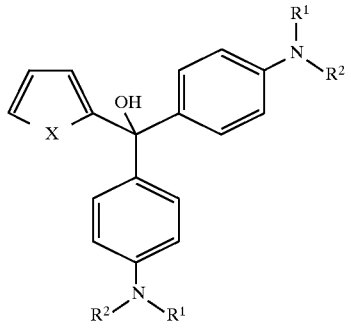

wherein;

each $R^1$ and $R^2$ is each independently selected from: alkyl groups of up to 20 carbon atoms, alkenyl groups of up to 20 carbon atoms, and aryl groups of up to 14 carbon atoms; or $R^1$ and $R^2$ of each $NR^1R^2$ group may represent the necessary atoms to complete a 5-, 6-, or 7-membered heterocyclic ring group; or one or more $R^1$ and $R^2$ of each $NR^1R^2$ group may represent the atoms necessary to complete a 5- or 6-membered heterocyclic ring group fused to the phenyl ring on which the $NR^1R^2$ group is attached;

X is O, S, or N—$R^3$; and $R^3$ is selected from alkyl groups of up to 20 carbon atoms, alkenyl groups of up to 20 carbon atoms, and aralkyl groups of up to 20 carbon atoms.

7. The construction according to claim 1 wherein the color-forming compound is represented by the general formula:

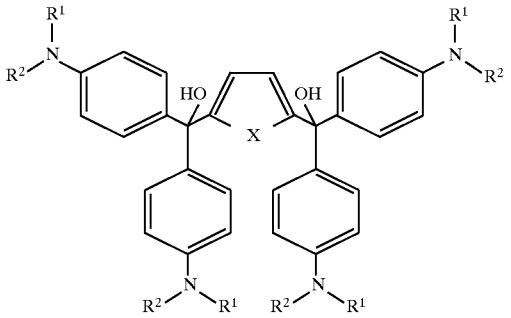

wherein;

each $R^1$ and $R^2$ is independently selected from alkyl groups of up to 20 carbon atoms, alkenyl groups of up to 20 carbon atoms, and aryl groups of up to 14 carbon atoms; or $R^1$ and $R^2$ of each $NR^1R^2$ group may represent the necessary atoms to complete a 5-, 6-, or 7-membered heterocyclic ring group; or one or more $R^1$ and $R^2$ of each $NR^1R^2$ group may represent the atoms necessary to complete a 5- or 6-membered heterocyclic ring group fused to the phenyl ring on which the $NR^1R^2$ group is attached;

X is O, S, or N—$R^3$; and $R^3$ is selected from alkyl groups of up to 20 carbon atoms, alkenyl groups of up to 20 carbon atoms, and aralkyl groups of up to 20 carbon atoms.

8. The construction according to claim 1 wherein said surface of said first substrate, which is coated with a 2-[bis[(4-amino)phenyl]hydroxymethyl]substituted furan, thiophene, and pyrrole color-forming compounds or a 2,5-bis-[bis[(4-amino)phenyl]hydroxymethyl]substituted furan, thiophene, and pyrrole color-forming compound is also coated with a fluoran, a rhodamine, or a triarylmethane lactone color-forming compound.

9. A method of forming an image comprising providing the imaging construction of claim 1 and applying pressure to the imaging construction thereby enabling the color-forming compound and the developer to react to form a colored image.

10. An imaging construction comprising:

a substrate having a front and back surface;

coated on at least one of the front and the back surfaces of the substrate, a color-forming compound selected from the group consisting of 2-mono-[bis[(4-amino)phenyl]hydroxymethyl]substituted furan, thiophene, and pyrrole compounds and 2,5-bis-[bis[(4-amino)phenyl]hydroxymethyl]substituted furan, thiophene, and pyrrole color-forming compounds;

a developer; and a means for separating the color-forming compound from the developer until the construction is subjected to heat.

11. The construction of claim 10 wherein the color-forming compound is represented by the general formula:

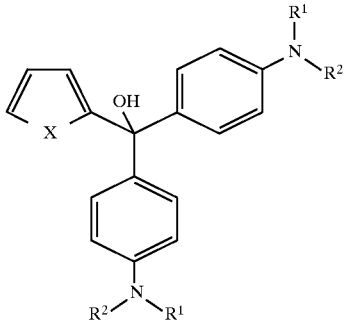

wherein, each $R^1$ and $R^2$ is each independently selected from: alkyl groups of up to 20 carbon atoms, alkenyl groups of up to 20 carbon atoms, and aryl groups of up to 14 carbon atoms; or $R^1$ and $R^2$ of each $NR^1R^2$ group may represent the necessary atoms to complete a 5-, 6-, or 7-membered heterocyclic ring group; or one or more $R^1$ and $R^2$ of each $NR^1R^2$ group may represent the atoms necessary to complete a 5- or 6-membered heterocyclic ring group fused to the phenyl ring on which the $NR^1R^2$ group is attached;

X is O, S, or N—$R^3$; and $R^3$ is selected from alkyl groups of up to 20 carbon atoms, alkenyl groups of up to 20 carbon atoms, and aralkyl groups of up to 20 carbon atoms.

12. The construction according to claim 10 wherein the color-forming compound is represented by the general formula:

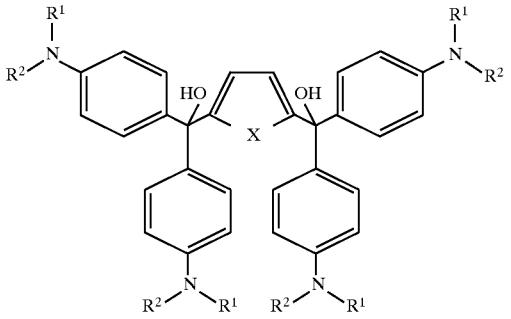

wherein, each $R^1$ and $R^2$ is independently selected from alkyl groups of up to 20 carbon atoms, alkenyl groups of up to 20 carbon atoms, and aryl groups of up to 14 carbon atoms; or $R^1$ and $R^2$ of each $NR^1R^2$ group may represent the necessary atoms to complete a 5-, 6-, or 7-membered heterocyclic ring group; or one or more $R^1$ and $R^2$ of each $NR^1R^2$ group may represent the atoms necessary to complete a 5- or 6-membered heterocyclic ring group fused to the phenyl ring on which the $NR^1R^2$ group is attached;

X is O, S, or N—$R^3$; and $R^3$ is selected from alkyl groups of up to 20 carbon atoms, alkenyl groups of up to 20 carbon atoms, and aralkyl groups of up to 20 carbon atoms.

13. A method of forming an image comprising providing the imaging construction of claim 10 applying heat to the construction in an imagewise manner thereby causing the color-forming compound to react with the developer to create a colored image.

* * * * *